US006003312A

United States Patent [19]

Schlichtig

[11] Patent Number: 6,003,312

[45] Date of Patent: Dec. 21, 1999

[54] ENGINE

[76] Inventor: Ralph Cortez Schlichtig, 11212 3rd Ave. So., Seattle, Wash. 98168

[21] Appl. No.: 09/184,683

[22] Filed: Nov. 2, 1998

[51] Int. Cl.[6] ..... F16D 31/02

[52] U.S. Cl. ..... 60/370; 123/59.3; 123/190.1

[58] Field of Search ..... 60/370, 404, 407, 60/716; 123/59.1, 59.3, 190.1

[56] References Cited

U.S. PATENT DOCUMENTS

| | | | |
|---|---|---|---|
| 1,731,015 | 10/1929 | Lehman | 123/59.1 |
| 1,754,509 | 4/1930 | Gilbert | 123/59.1 X |
| 1,755,976 | 4/1930 | Williams | 123/59.1 |
| 3,693,351 | 9/1972 | Minkus | 60/370 |
| 3,885,387 | 5/1975 | Simington | 60/370 |
| 4,171,618 | 10/1979 | Aegerter | 60/370 X |

*Primary Examiner*—Hoang Nguyen

[57] ABSTRACT

In accordance with this invention a vapor engine is provided having a first piston of a given diameter and a second piston having a larger diameter than the first piston. Walls are provided within which the pistons travel so as to define a first piston space and a second piston space. An apparatus are provided for connecting the first and the second piston to a power output. A rotary valve, having passageways therein for communicating with the first piston space and with the second piston space and for receiving vapor under pressure from an input source and for discharging exhaust vapor from the engine, is a part of the combination. Another apparatus is provided for positioning the rotary valve in accordance with the positioning of the first and second piston, so that during a first phase power stroke relative to the first piston, the pressure vapor power input to the first piston space from its passageway in the rotary valve ends only at the end of the first piston power stroke while exhausting discharge vapor from the second piston space all during the power stroke of the first piston, and so that during a second phase power stroke relative to the second piston vapor under pressure is applied to the second piston by a passageway in the rotary valve, and thus vapor under pressure flows from the first piston space to the second piston space.

6 Claims, 3 Drawing Sheets

ENGINE

This invention relates to a vapor engine and, more particularly, to a two-phase engine having a first piston for the intake stroke and a second piston of larger diameter for the exhaust stroke.

BACKGROUND OF THE INVENTION

The conventional steam engine is an example of the prior art relative to this invention which will be described in detail hereinafter. If the input pressure with respect to the condenser is beyond design pressure one exhausts from the engine to the condenser too early, thus losing engine power and efficiency by exhausting vapor to the condenser that is at a usable pressure. If, on the other hand, the pressure is below the design pressure, then the pressure of the expanded gas goes to a pressure or vacuum to thus cause a reverse force on a piston with a loss of engine power and efficiency. Thus, in operation, in a steam engine, the design pressure ratio must be maintained to maintain suitable efficiency.

Since water is used for the vapor in a conventional steam engine, it requires a relatively large amount of heat for producing a mole of vapor. This reduces the thermal efficiency of the engine. In addition, water vapor being at a lower pressure at a given temperature than in the case of a refrigerant vapor as used in the present invention, and thus, requires a much larger piston displacement of volume, thus requiring a larger engine for the same power delivered. In that the working temperature of water is much higher than that of refrigerants, a much higher boiler temperature must be maintained to get suitable power output.

Turbines, because of critical design limitations relative to for instance pressure ratios, are expensive to manufacture.

Accordingly, there exists a need to provide a vapor powered engine which can operate from low grade heat energy efficiently without the many critical design limitations as hereinbefore mentioned.

SUMMARY OF THE INVENTION

Therefore, in accordance with this invention, a two-phase vapor engine having a first piston for the intake stroke and a second piston of larger diameter for the exhaust is provided. A rotary valve having passageways therein for communicating with the first piston space and the second piston space and for receiving vapor under pressure from an input source and for discharging exhaust vapor from the vapor engine is also provided. Means is also provided for positioning the rotary valve in accordance with the positioning of the first and second piston so that during a first-phase power stroke relative to the first piston, the pressure vapor power input to the first piston space from the passageway in the rotary valve ends only at the end of the first piston power stroke and so that during a second phase power stroke relative to the second piston vapor under pressure is applied to the second piston by means of a passageway in the rotary valve and, thus, vapor under pressure flows from the first smaller piston space to the second larger piston space.

Therefore, an object of this invention is to provide a vapor powered engine which can operate efficiently from low grades of heat energy over a wide range of pressure ratio between engine input and exhaust pressure by providing an engine having an input metering piston and a larger diameter vapor expansion and exhaust piston and a cylindrical valving system for ending the vapor power input only at the end of the piston power stroke while exhausting vapor from the vapor space of the larger piston during all of the power stroke.

Another object of this invention is to provide the aforementioned vapor power engine suitable for operation from a relatively low pressure ratio by so valving the engine during an extended power stroke following the initial power stroke that power vapor enters the larger piston space during substantially all of the additional power stroke.

A further object is to provide the aforementioned vapor power engine suitable for operation from a higher pressure ratio by so valving the engine during the expansion stroke that vapor within the larger and smaller piston spaces adiabatically expands during substantially all of the expansion stroke.

Another object of this invention is to reduce the amount of heat that must be delivered to the boiler for a given engine output to thus improve engine efficiency by using a chemical such as a refrigerant for the power fluid which has a lower molar heat of vaporization than the molar heat of vaporization of water.

Still another object of this invention is to provide a vapor engine that will operate at sufficiently low boiler temperatures to use such as geothermal heat, solar heat and various sources of waste heat.

A further object of this invention is to provide a vapor engine that will efficiently operate over a wide range of pressure ratio between boiler pressure and condenser pressure.

BRIEF DESCRIPTION OF THE DRAWINGS

The accompanying drawings, which are incorporated and form a part of the specification, illustrate the present invention, and, together with the description serve to explain the principles of the invention. In the drawings.

DETAILED DESCRIPTION OF THE INVENTION

Figure 1:
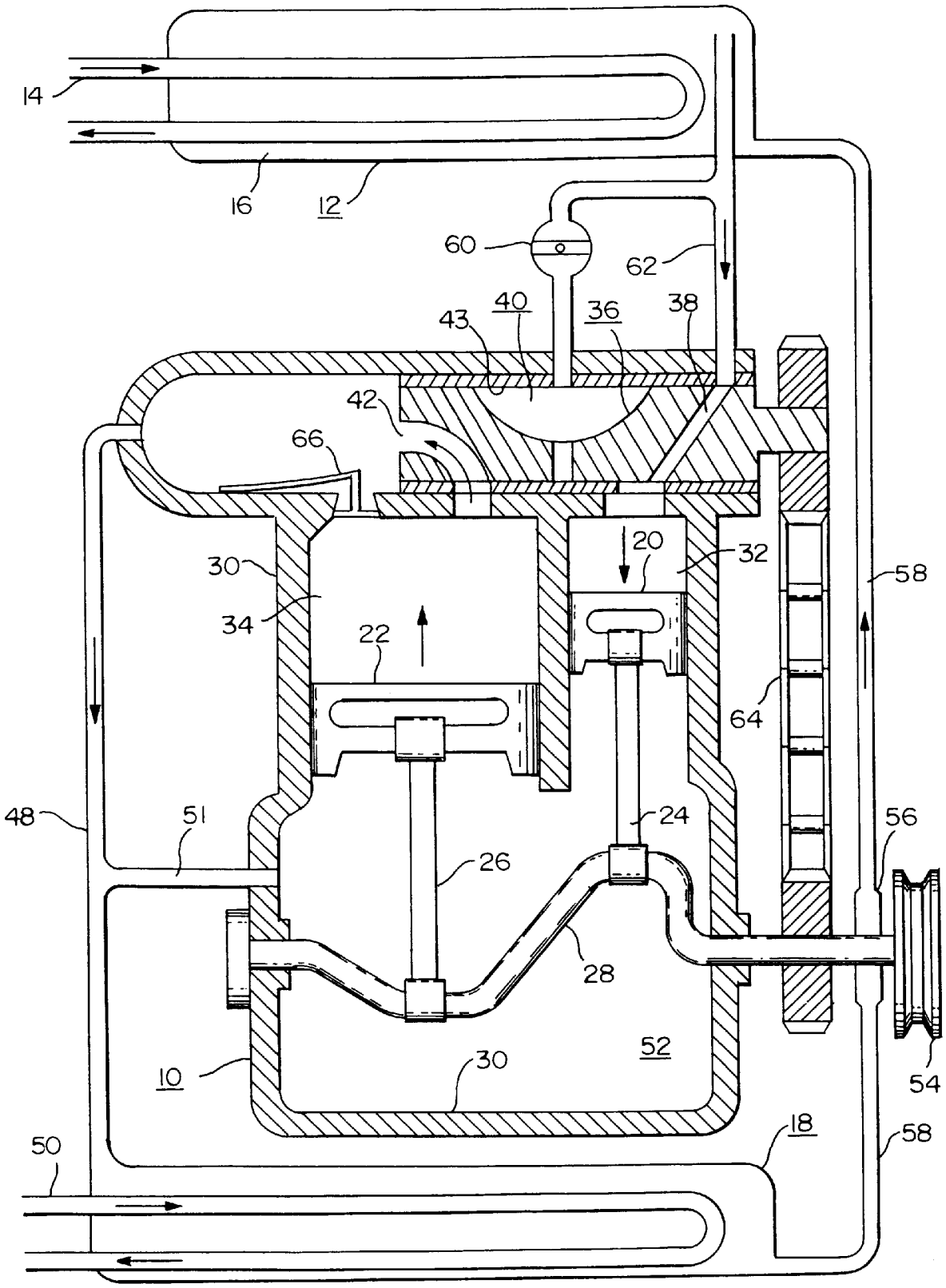
FIG. 1 is a schematic diagram of the vapor engine embodying the teachings of this invention, and showing the positioning of the components of the engine at near the beginning of the intake stroke of the input piston and the exhaust stroke of the larger output piston.
Figure 2:
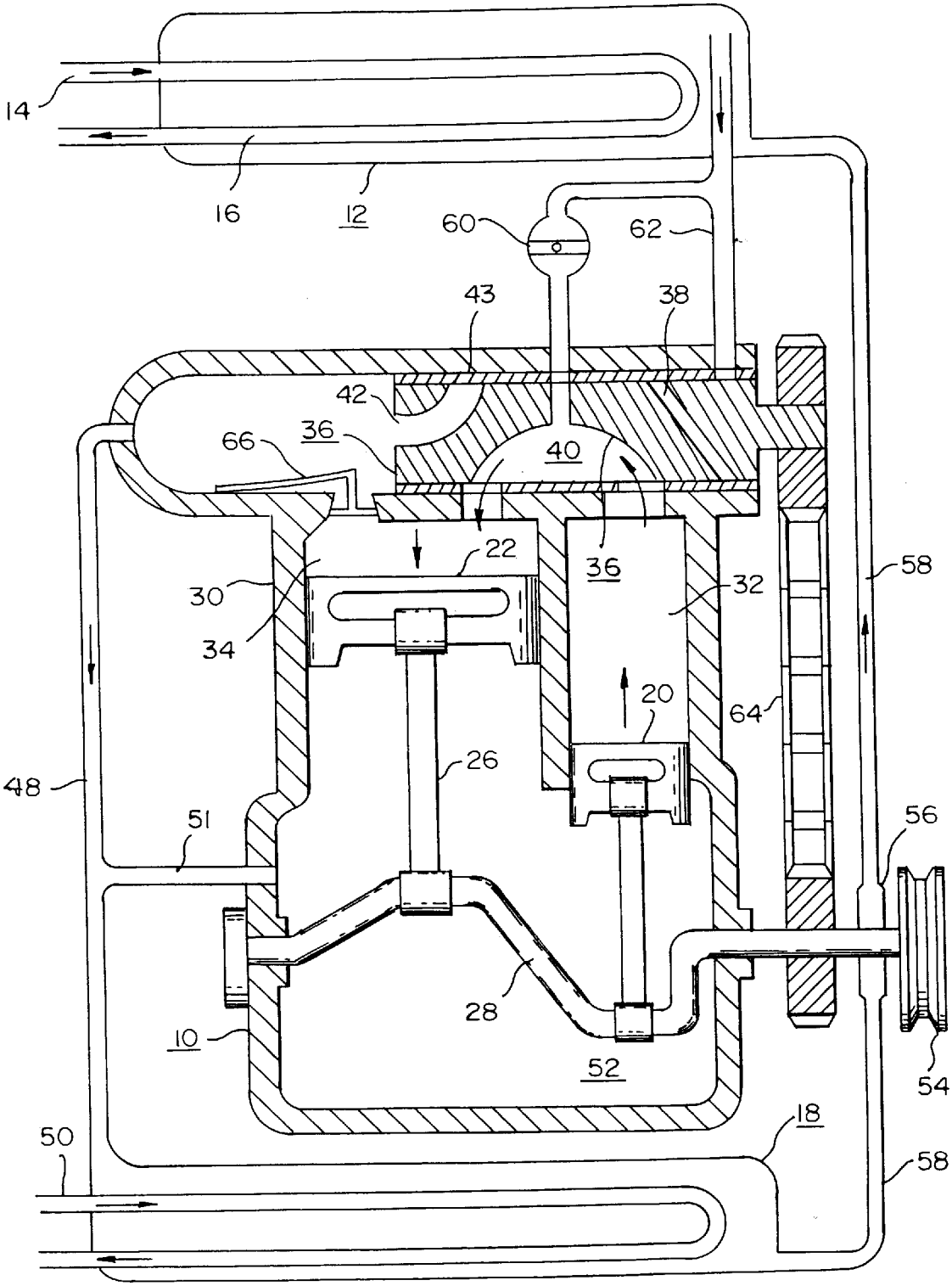
FIG. 2 is a schematic diagram of the vapor engine embodying the teachings of this invention and showing the positioning of the components of the engine at the beginning of the expansion stroke of the input piston, and the beginning of the expansion stroke of the larger output piston with the selector valve in the high pressure ratio mode.

Reference will now be made in detail to a higher pressure ratio (between for instance boiler and condenser) mode, an example of which is illustrated in FIGS. 1 and 2 of the accompanying drawings.

The invention includes means for providing a vapor powered engine 10 which can operate efficiently from low grades of heat energy over a wide range of pressure ratio between engine input pressure and exhaust pressure. The pressurized intake vapor for the engine is received from a boiler 12 which includes a heat exchanger 14 which is submerged in liquid refrigerant 16 disposed within the boiler 12. In that the thermal efficiency of a vapor type engine is limited by the thermal efficiency of the fluid used, it is important to make the proper choice of fluid to use. For comparison purposes, we will choose a boiler temperature of 100 degrees F. (560 degrees R) and a temperature at a condenser 18 of 50 degrees F. The general second law of thermodynamics would yield:

$$\frac{\text{Heat input}}{\text{Maximum work output}} = \frac{560}{100-50} = 11.2$$

$$\frac{\text{Heat of vaporization per pound}}{\text{Work in expanding of a pound of vapor}} = \frac{1002}{78.5} = 12.8$$

Use of refrigerant 134A in the boiler 12 would yield per pound:

$$\frac{\text{Heat of vaporization per pound}}{\text{Work in expanding a pound of vapor}} = \frac{75.1}{7.84} = 9.5$$

Thus refrigerant 134A as compared to water, requires less heat from boiler 12 for each unit of output work.

The engine 10 comprises an input metering piston 20 of a given diameter and a larger diameter vapor expansion and exhaust piston 22 having connecting rods 24 and 26 connecting the pistons 20 and 22 to a crank shaft 28. A housing 30 defines a small piston space 32 and a larger piston space 34 within which the pistons 20 and 22 travel.

A rotatable cylindrical shaped valve 36 having passageways 38, 40 and 42 communicating with the piston spaces 32 and 34 and the boiler 12 and the condenser 18, is provided for ending the vapor power input from the boiler 12 only at the end of the piston 20 power stroke while exhausting vapor from the vapor space 34 of the larger diameter piston 22 during all of the power stroke of the input piston 20. In order to minimize leakage of the refrigerant such as 134A from one space to another, a cylindrical shaped sleeve 43 made from such as a self lubricating polymer including a poly amide imide polymer is provided.

Referring to FIG. 1 as the piston 22 rises and decreases the piston cylinder space 34, vapor is exhausted through the exhaust part 42 and continues through the exhaust tube 48 to the condenser 18. Here the vapor pressure of the refrigerant present is kept low by the low temperature fluid in the heat exchanger 50, which condenses the vapor to liquid. There is also a connection 51 from a crank case 52 and the exhaust tube 48 to stabilize the pressure in the crank case 52.

The downward force on the intake smaller piston 20 is transmitted through the connecting rod 24 to the crank shaft 28 mounted in the closed crank case 52. The torque is transmitted to an external fly wheel 54 and to a fluid pump 56 for pumping refrigerant fluid back to the boiler 12 by a duct 58, and during this phase for delivering upward motion to the larger diameter piston 22 to exhaust the expanded vapor from the piston space 34. The pressure within the crank case 52 is stabilized at the condensing pressure within the condenser 18 by the connecting tube 48.

Again referring to FIG. 1, a selector switch 60 is provided for operating the engine 10 at higher and lower pressure ratios between the boiler 12 pressure and the pressure within the condenser 18. A simple means of preventing a final negative power effect is to avoid allowing the cylinder space 34 to drop below condenser 18 pressure by providing a check valve 66 to allow makeup vapor to then enter the cylinder space 34 from the exhaust tube 48.

In practice, other refrigerants of low molar heat of vaporization can be used in the boiler 12 and within the condenser 18. In FIG. 1, the switch 60 is shown in the closed position and in operation with reference to FIG. 1 vapor from the boiler 12 flows through a connector tube 62 through the passageway 30 and exerts pressure on the power stroke piston 20 driving it downward and the larger exhaust piston 22 upward to exhaust the vapor within the space 34 through the passageway 42 of the valve 36, and the tube 48 to the condenser 18 where the vapor is condensed and turned into a liquid for pumping by means of the pump 56 back into the boiler 12. As hereinbefore mentioned the downward force on the power stroke piston 20 exerts a torque on the fly wheel 54 and provides mechanical power at the output of the crankshaft 28.

In operation the rotary valve 36 ends the vapor power input from the boiler 12 only at the end of the piston 20 power stroke while exhausting vapor from the space 34 during all the power stroke of the input piston 20.

Referring to FIG. 2 there is illustrated the vapor expansion cycle of the engine 10 with the selector switch 60 in the higher pressure ratio mode that is with a higher pressure ratio between the boiler 12 and the condenser 18. In FIG. 2 both the crank shaft 28 and the rotary valve 36 are rotated 180 degrees from the phase shown in FIG. 1. The two rotations are kept in phase by, for instance, a chain link drive 64. This phase starts with the smaller cylinder space 32 charged with high vapor pressure from the boiler 12. At this phase the rotary valve 36 has closed the passgeway 38 from the boiler 12, but has positioned the passage 40 to connect the cylinder space 32 above the smaller piston 20 to the space 34 above the larger piston 22, thus transferring the vapor from the piston space of 32 to the piston space of 34 to allow adiabatic expansion of the vapor to take place and a force to be exerted on the piston 22.

As the larger piston 22 moves down and increases the combined volume of the cylinder spaces 32 and 34, adiabatic expansion of the vapor takes place with decrease in pressure. Should the initial boiler pressure be too low, this later pressure may drop below condenser pressure.

During the phase illustrated in FIG. 2 the downward force of the larger diameter piston 22 exerts a torque on the crank shaft 28.

Figure 3:
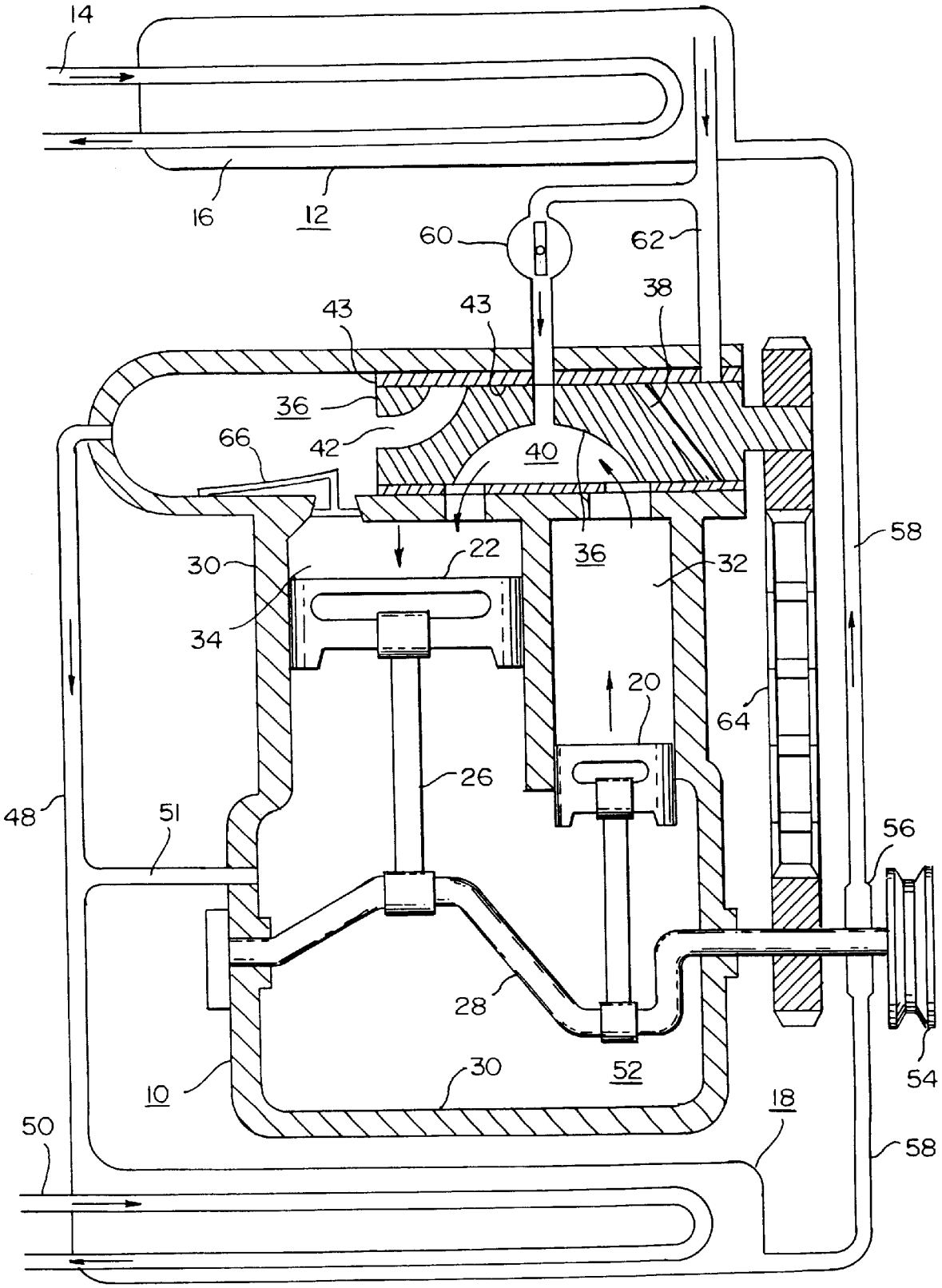
FIG. 3 is a schematic diagram of the vapor engine embodying the teachings of this invention, and showing the positioning of the components of the engine at the beginning of the output stroke of the input piston and the beginning of the downward stroke of the larger output piston with the selector valve in the lower pressure ratio mode so that vapor is admitted to the space of the larger piston directly from the boiler into the output from the smaller piston space.

Referring to FIG. 3, in which the components of FIGS. 1, 2 and 3 have been given the same reference characters, there is illustrated the mode of operation of the engine 10 when the pressure in the boiler is so little above the condenser 18 pressure that expansion would be of little value. This is the low pressure ratio mode between the boiler 12 and the condenser 18. When operating in this mode the selector switch 60 is in the open position. In FIG. 3 the operation of the equipment is the same for the first part of the power stroke as was described with reference to the operation of the equipment shown in FIG. 1. The main difference is that in the next part of the cycle and with the selector switch 60 open, vapor is permitted to enter the piston space 34 directly from the boiler 12 through the passageway 40 of the rotary valve 36 and no adiabatic expansion of the vapors takes place within the space 32 or 34. During this extended power stroke pressure from the large piston 22 exerts a torque on the crank shaft 28. During this extended power stroke of the engine 10 the valve 36 and its passageways 38, 40 and 42 are positioned as shown in FIG. 3.

The apparatus embodying the teachings of this invention has several advantages. For instance, the engine 10 embodying the teachings of this invention can operate from low grades of heat energy found all over the world, such as solar, geothermal, and ocean temperature differences, and can operate at a necessary efficiency.

Also, the engine 10 is relatively simple, and, thus, initial first costs are kept to a minimum.

Further, the engine 10 can operate from a wide range of temperature differences between, for instance, the boiler and condenser.

Furthermore, the engine is a safe device with low maintenance and replacements costs.

I claim as my invention:

1. In a vapor engine, the combination comprising, a first piston of a given diameter; a second piston having a larger diameter than the first piston; walls within which said first piston and said second piston travel so as to define a first piston space and a second piston space; means connecting said first piston and said second piston to a mechanical output to provide a power output; a rotary valve, having passageways therein for communicating with the first piston space and with the second piston space and for receiving pressure vapor from an input source and for discharging exhaust vapor from the vapor engine; means for positioning said rotary valve in accordance with the positioning of said first piston and said second piston so that during a first phase power stroke relative to said first piston, the pressure vapor power input to the first piston space from the passageways in said rotary valve ends only at the end of said first piston power stroke while exhausting discharge vapor from the second piston space all during the power stroke of said first piston, and so that during a second phase power stroke relative to said second piston vapor under pressure is applied to said second piston by means of a passageway in said rotary valve and, thus, under pressure, vapor flows from the first piston space to the second piston space.

2. The vapor engine of claim 1 in which the rotary valve is disposed in and travels within a cylindrical sleeve made from a self lubricating polymer including poly amide imide polymers.

3. In a vapor power system, the combination comprising, a boiler for producing a pressurized vapor; a first piston of a given diameter; a second piston having a larger diameter than said first piston; walls within which said first piston and said second piston travel so as to define a first piston space and a second piston space; means connecting said first piston and said second piston to a mechanical output to provide a power output; a condenser for receiving and condensing exhaust vapor; a rotary valve having passageways therein for communicating with the first piston space and with the second piston space and for receiving the pressure vapor from said boiler and for discharging exhaust vapor to said condenser; means for positioning said rotary valve in accordance with the positioning of said first piston and said second piston so that during a first phase power stroke relative to said first piston the pressurized vapor power input to the first piston space from the passageway in said rotary valve ends only at the end of said first piston power stroke while exhausting discharge vapor from the second piston space to said condenser all during the power stroke of said first piston, and so that during a second phase power stroke relative to said second piston vapor under pressure is applied to said second piston by means of a passageway in said rotary valve and thus pressurized vapor flows from the first piston space to the second piston space.

4. The combination of claim 3 in which the boiler contains a refrigerant with low molar heat of vaporization producing a pressurized vapor of such refrigerant.

5. The combination of claim 3 in which a control means is dispersed between said boiler and said rotary valve to control the flow of pressured vapor from said boiler through said rotary valve to the piston space of said second piston.

6. The combination of claim 5 in which said control means has an open and a closed position and while in the open position pressurized vapor flows from said boiler through the passageway of said rotary valve to the piston space of said second piston so as to exert a force on said second piston during the second phase power stroke relative to said second piston and while in the closed position and during the second phase power stroke relative to said second piston adiabatic expansion of the vapor within the piston space of said first piston causes a force to be exerted on said second piston.

* * * * *